United States Patent [19]

Voegele

[11] Patent Number: 4,622,743

[45] Date of Patent: Nov. 18, 1986

[54] DEVICE FOR CUTTING SHEETS OF SOFT MATERIAL

[76] Inventor: Richard Voegele, Bernaustrasse 367, CH-4353 Leibstadt, Switzerland

[21] Appl. No.: 745,419

[22] Filed: Jun. 14, 1985

[51] Int. Cl.[4] ..... B26D 7/10

[52] U.S. Cl. ..... 30/140; 30/278; 30/293; 83/171; 83/580

[58] Field of Search ..... 30/278, 282–286, 30/289, 290, 293, 294, 140, 128; 83/171, 580

[56] References Cited

U.S. PATENT DOCUMENTS

| | | | |
|---|---|---|---|
| 2,438,156 | 3/1948 | Dodge | 83/171 X |
| 2,814,875 | 12/1957 | Seals | 30/289 X |
| 3,438,129 | 4/1969 | Spangler | 83/580 X |

FOREIGN PATENT DOCUMENTS

| | | | |
|---|---|---|---|
| 771981 | 11/1967 | Canada | 30/278 |

*Primary Examiner*—James M. Meister

*Attorney, Agent, or Firm*—Tilton, Fallon, Lungmus & Chestnut

[57] ABSTRACT

The apparatus serves for cutting sheets from soft material, such as plastic-foam sheets or sheets of glass wool or rock wool, including a casing of rectangular cross-section and having guide rollers. At one end of the casing there is a guillotine-like guided cutting device which, depending on the material of the sheet to be cut, may be an electrically heated wire or a blade. The device finding particular use in construction, where internal walls, facades, or flat roofs are sheathed with thermally insulating insulation sheets.

6 Claims, 2 Drawing Figures

DEVICE FOR CUTTING SHEETS OF SOFT MATERIAL

BACKGROUND AND SUMMARY OF INVENTION

Sheets of soft material are frequently used these days in the construction industry for thermal insulation, both in internal spaces as well as in external facades. The sheets consist of foamed plastics, such as, for example, Styropor (TM) or glass wool or rock wool. They are mainly delivered in standard sizes, but must, however, be cut to size at the construction site.

For cutting Styropor (TM) sheets to size, light, transportable cutting devices which consist of an electrically heatable blade with a handle are known. In using such a hand device, sliding along a straight edge for guiding is necessary, which makes for more difficult work, especially at the construction site.

Also, a stationary belt-saw-like device with an electrically heated cutting wire is known, but cumbersome to use at the site.

The task which is the basis of the invention is that of creating a transportable cutting apparatus of lightweight construction by means of which trimming of insulating sheets can be carried out relative to stationary building parts, even by untrained hands.

The invention solves this task with an apparatus which has a casing, slidably guiding and supporting the sheet to be cut, one end of said casing being provided with a guillotine-like guided cutting device, at least one stop 9 being arranged on the outside of said casing in alignment with said cutting device.

It is advantageous if the casing is provided with adjustable rollers to adapt the apparatus to the width and thickness of the sheet to be cut.

The apparatus as specified by the invention serves, in the construction industry above all, for trimming insulating sheets, as necessary for flat roof or facade insulation.

After having introduced the insulation sheet between the rollers in the casing, the hands are free for handling the apparatus, and furthermore, the leftover piece, after the sheet has been cut, does not fall out of the apparatus but remains clamped between the rollers. By pushing the remaining part of the sheet through the apparatus it can immediately be used again for the next trimming. The leftover sheet and the apparatus are always together.

In the appended drawing, an example of the inventive apparatus is depicted and its use explained:

DETAILED DESCRIPTION

Figure 1:
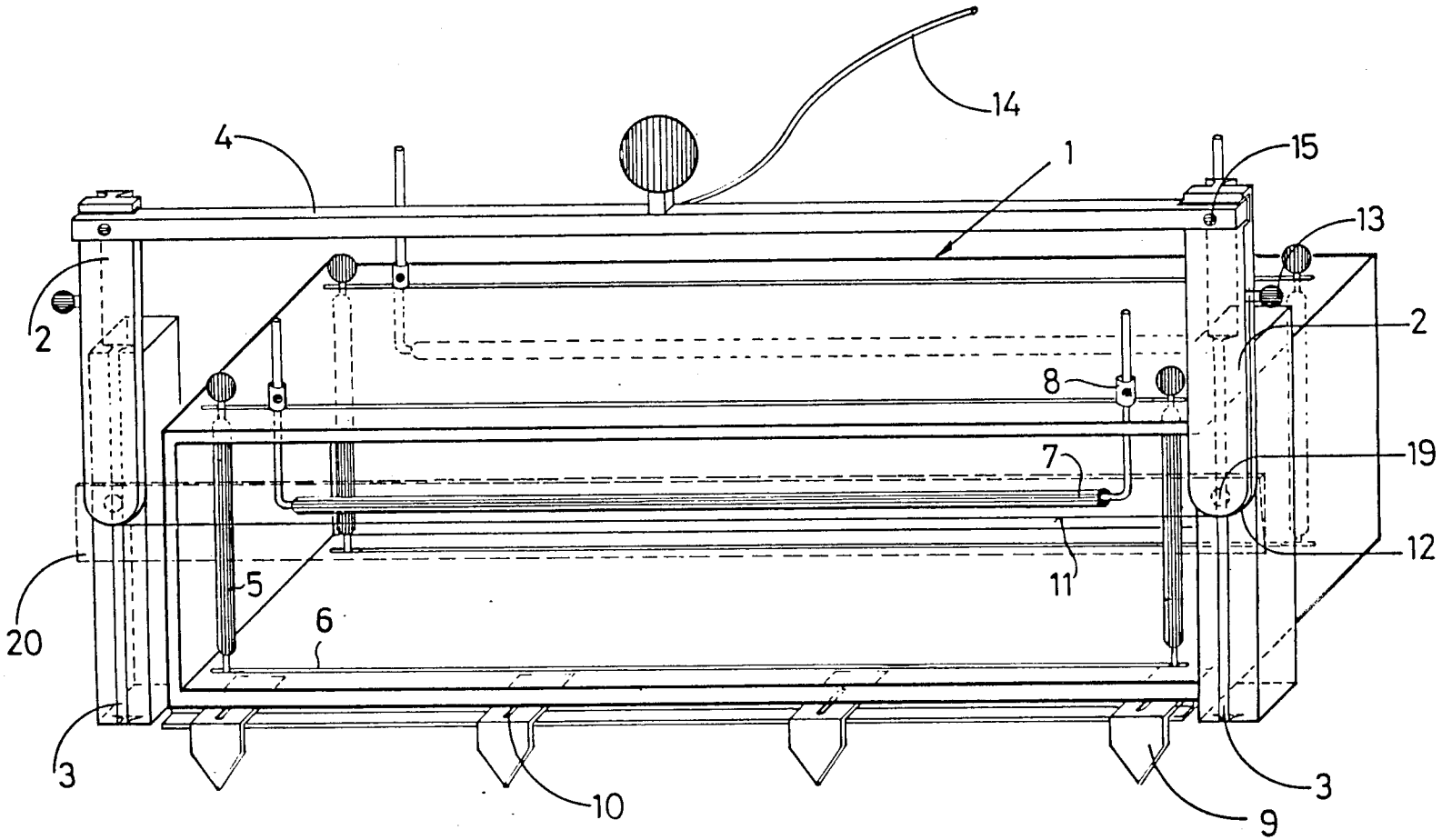
FIG. 1 is a perspective view of the cutting apparatus.

The principal components of the device are as follows: a tunnel-like casing 1 with two lateral guiding posts 3, into which slides 2 are mounted in a sliding manner in dovetailed grooves. A connecting beam 4 links both slides 2 with one another. An electrically heatable wire 11 (or a blade 20 replacing this wire, represented by the dotted line) form, together with the slide and the connecting beam 1, a guillotine-like, guided cutting device.

In the casing 1 there are positioned four laterally positioned guide rollers 5 which are introduced into the slots 6, and can be adjusted and fixed according to the width of the sheet to be cut. In the upper part of the casing, two adjustable rollers 7 are positioned; these serve for the adjustment of the thickness of the sheet to be cut. These can be adjusted and fixed by means of the mounting supports 8.

For the movable rollers which are intended for guiding and supporting the sheets, it is best to use rubber or foamed plastic so that the sheet edges will not be damaged. It would also be possible to work without rollers, if the sheets fit exactly into the casing. On the underside of the casing 1, "L"-shaped stops 9, which can be slid in the slots 10 for adjustment are positioned.

Both guiding posts 3 are attached laterally on the casing 1; these are made from electrically-insulating material, while the slide units 2 are made from metal.

If the device is used for cutting plastic foam sheets, a cutting wire 11 is stretched between the slides 2. The wire 11 is guided in the slots 12 of the slides, and its ends are attached with the screws 13.

The connecting beam 4 consists of electrically insulating material, or of metal which is provided with an insulating layer so that it does not electrically span the cutting wire. According to need, metallic screws 15 can be sued or, in other cases, screws of plastic material must be used in order to link the connecting beam 4 with the slides 2

If sheets of glass wool or rock wool must be cut by means of the apparatus, the cutting wire is replaced by the blade 20, which is connected by means of screw 19 with the slides 2.

Figure 2:
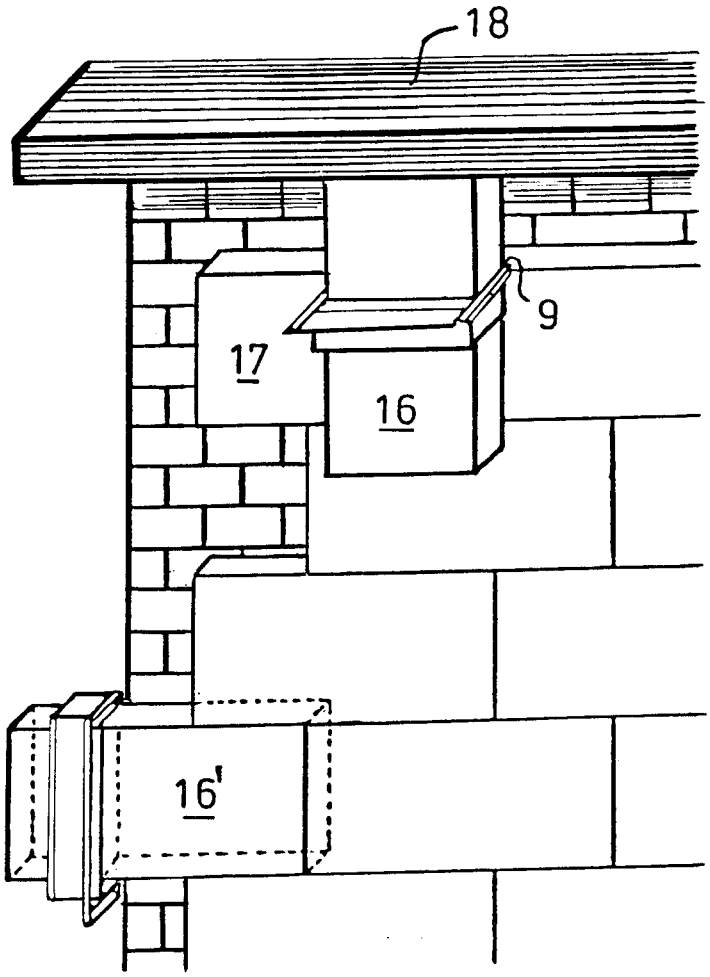
FIG. 2 is a view of the apparatus in use.

The manner of operation of the device as specified by the invention can be seen from FIG. 2 The task at hand may consist, for example, of precisely trimming the insulating sheet 16 between the upper edge of the sheet 17 and the window sill. In order to bring the device into the working position, the sheet 16 is introduced into the casing 1, and the stop 9 is laid on the upper edge of the sheet 17 already glued to the wall, and the casing 1 is pressed to the sheet 17 with light pressure.

Now the insulation sheet is pushed through the apparatus up to the window sill, and the cutting proceeds precisely over the upper edge of the already-mounted insulation sheet, since the cutting wire is arranged in the same plane as the stop 9 on the base of the casing.

The cutting wire 11 is now pressed upon the sheet surface 16 to the "L"-shaped stop 9, whereby the sheet is precisely cut through at the desired spot.

Another use of the apparatus is represented in the lower part of FIG. 2. Here, by means of the apparatus an insulating sheet 16' is snugly cut to the edge of the wall. The stops now rest against the edge of the wall.

The apparatus can also be used for cutting a sheet in the horizontal plane. The device is fastened to the table, the slides 2 are fixed with screws 19 at the desired height, and the insulating sheet is pushed from behind through the casing so that two 5 cm-thick sheets can be cut, for example, from a 10 cm insulating sheet. The cutting wire guides 2 can also be fixed at different height, so that various diagonal cuts are also possible.

I claim:

1. An apparatus for cutting sheets of soft material, characterized by a casing, slidably guiding and supporting the sheet to be cut, one end of said casing being provided with a guillotine-like guided cutting device, at least one stop means being arranged on the outside of said casing in alignment with said cutting device, and adjustable rollers arranged in said casing to adapt the apparatus to the width and thickness of the sheet to be cut.

2. Appartus as claimed in claim 1, characterized in that said stop means are adjustable and protrude from the outside of said casing.

3. Apparatus as claimed in claim 1, characterized in that the casing has a tunnel-like form of rectangular shape.

4. An apparatus for cutting sheets of soft material, characterized by a casing, slidably guiding and supporting the sheet to be cut, one end of said casing being provided with a guillotine-like guided cutting device, at least one stop means being arranged on the outside of said casing in alignment with said cutting device, dovetailed guiding posts of electrically insulating material being attached on opposite sides of said casing, two slides being slidably arranged in said guiding posts, said slides supporting said cutting device and being connected to one another by means of a connecting beam.

5. Apparatus as claimed in claim 4, characterized in that the cutting device is an electrically heated cutting wire stretched between said slides, said connecting beam being electrically insulated from said slides, a flexible electric current supply cable ensuring the supply of current to said cutting wire.

6. Apparatus as claimed in claim 4, characterized in that the cutting device is a cutting blade attached to said slides.

* * * * *